US008192254B2

(12) United States Patent
Fukinuki et al.

(10) Patent No.: US 8,192,254 B2
(45) Date of Patent: Jun. 5, 2012

(54) SANDER WITH A BALANCE MEANS

(75) Inventors: Masatoshi Fukinuki, Nanjing (CN); Gan Wei, Nanjing (CN)

(73) Assignee: Chervon Limited, Wanchai (HK)

( * ) Notice: Subject to any disclaimer, the term of this patent is extended or adjusted under 35 U.S.C. 154(b) by 333 days.

(21) Appl. No.: 12/590,468

(22) Filed: Nov. 9, 2009

(65) Prior Publication Data

US 2010/0120340 A1 May 13, 2010

(30) Foreign Application Priority Data

Nov. 12, 2008 (CN) ..... 2008 2 0217867 U

(51) Int. Cl.
*B24B 23/04* (2006.01)
*B24B 41/02* (2006.01)

(52) U.S. Cl. ..... 451/343; 451/356; 451/357

(58) Field of Classification Search ..... 451/343, 451/356, 354, 357–359, 344, 559
See application file for complete search history.

(56) References Cited

U.S. PATENT DOCUMENTS

| | | | | |
|---|---|---|---|---|
| 4,158,246 | A * | 6/1979 | Meadows et al. | 15/28 |
| 4,624,078 | A * | 11/1986 | Van Rijen et al. | 451/357 |
| 4,625,462 | A * | 12/1986 | Fushiya et al. | 451/357 |
| 6,447,383 | B2 * | 9/2002 | Oda et al. | 451/357 |
| 6,971,951 | B2 * | 12/2005 | Boyer | 451/344 |
| 7,771,253 | B2 * | 8/2010 | Wuensch | 451/344 |
| 2008/0254721 | A1 | 10/2008 | Wuensch | |

* cited by examiner

*Primary Examiner* — Dung Van Nguyen
(74) *Attorney, Agent, or Firm* — McDermott Will & Emery LLP

(57) ABSTRACT

A sander according to the present invention comprising a housing, a motor and a transmission mounted within the housing, a sanding plate mounted below the housing, a battery pack mounted at the rear end of the housing and a balancer mounted on either the housing or the sanding plate. The balancer includes a balance element disposed in the front part of the sander. The balance element is balanced with the battery pack, which solves the balance problem of the DC sanders known in the prior art while still providing a battery pack that can satisfy the power requirements of the sander.

18 Claims, 3 Drawing Sheets

SANDER WITH A BALANCE MEANS

CROSS-REFERENCE TO RELATED APPLICATIONS

This application claims priority under 35 U.S.C. §119 to CN 200820217867.2 filed Nov. 12, 2008, which is hereby incorporated by reference.

FEDERALLY SPONSORED RESEARCH OR DEVELOPMENT

Not Applicable.

TECHNICAL FIELD

The present invention relates to a sander, and more particularly, to a sander powered by a battery pack.

BACKGROUND OF THE INVENTION

A sander is commonly used in profiling wood. A sander generally comprises a housing and a sanding plate mounted below the housing. A motor and a transmission are disposed within the housing. The sanding plate is connected to an output end of the transmission. Sanding paper is attached to the bottom of the sanding plate. The sanding plate is driven by the motor and when used, results in the sanding of a workpiece surface.

As shown in the prior art, a sander powered by a battery pack is convenient to carry and is easily adapted for use in different work situations. The battery pack is usually mounted at the rear of the sander so that the height of the sander is not increased. This arrangement results in the sander having a compact structure and small size, which allows the user to easily control the movement of the sander.

The battery pack at the rear end of the sander may be heavy. Although there are low weight battery packs on the market, the lighter battery packs do not provide the required satisfactory power for known sanders. As a result, a sander with a relatively high-power and heavy battery pack may be unbalanced because the high-power battery pack changes the center of gravity of the sander, and the sander is no longer balanced. Instead of being balanced, the center of gravity of the sander is moved closer to the rear, and as a result, when the sander is placed on a work table the sander is easy to flip over backwards. Also, the changed center of gravity may make control of the sander more difficult for a user.

SUMMARY OF THE INVENTION

A sander according to the present invention has a housing, a motor mounted within the housing, a transmission mounted within the housing, a sanding plate mounted below the housing, a battery pack mounted at the rear end of the housing, a balancer mounted on one of the housing and the sanding plate, the balancer including a balance element disposed in the front part of the sander.

In the present invention, the balance element is balanced with the battery pack, which solves the balance problem in the prior art while allowing the battery pack to satisfy the desired power requirements of the sander. Therefore, the user can effectively carry out the desired sanding task using the sander.

BRIEF DESCRIPTION OF THE DRAWINGS

The present invention will become apparent from the following detailed description of the preferred embodiment of the invention illustrated in the accompanying drawings, wherein.

DETAILED DESCRIPTION

Figure 1:
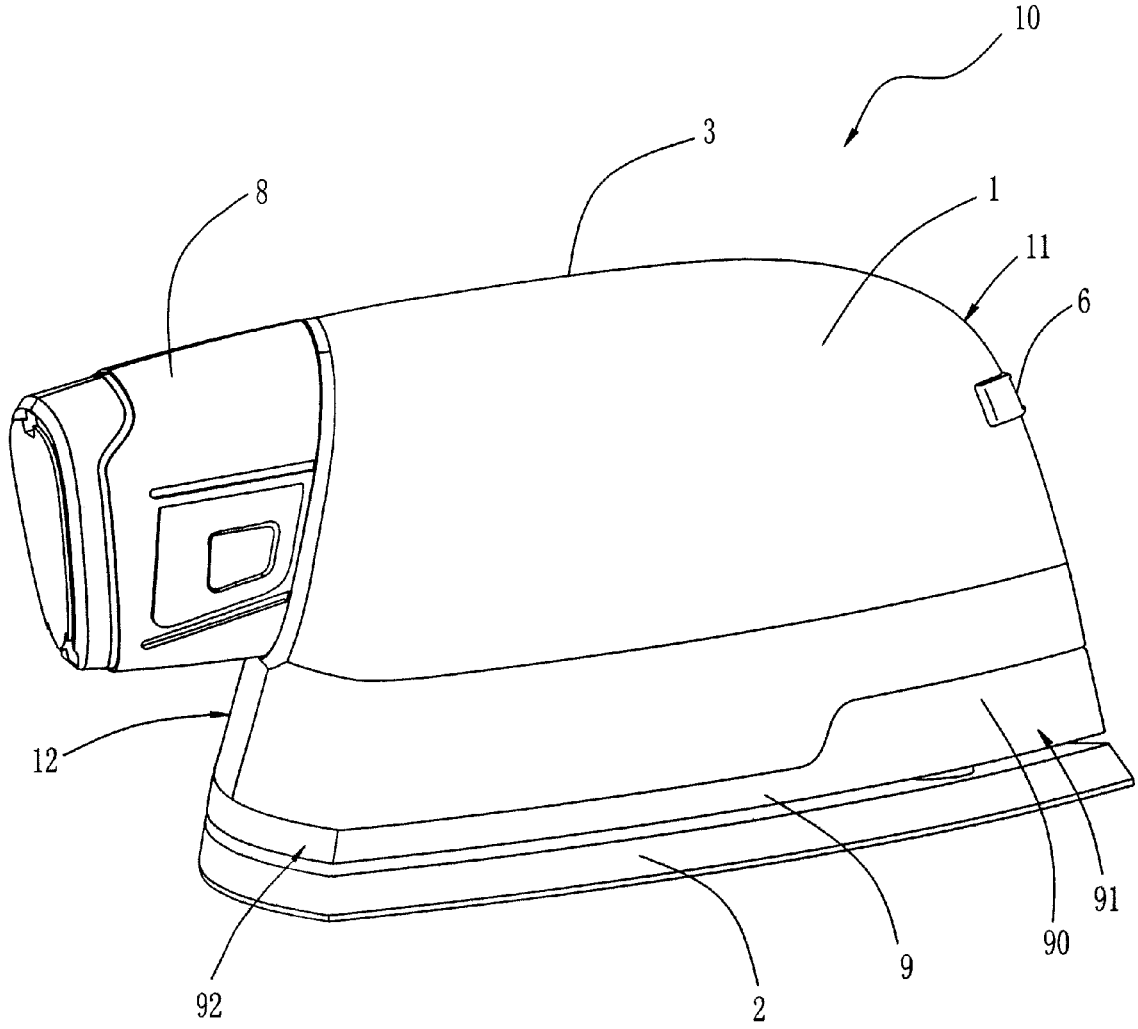
FIG. 1 is a perspective view of a sander of one embodiment according to the present invention.
Figure 2:
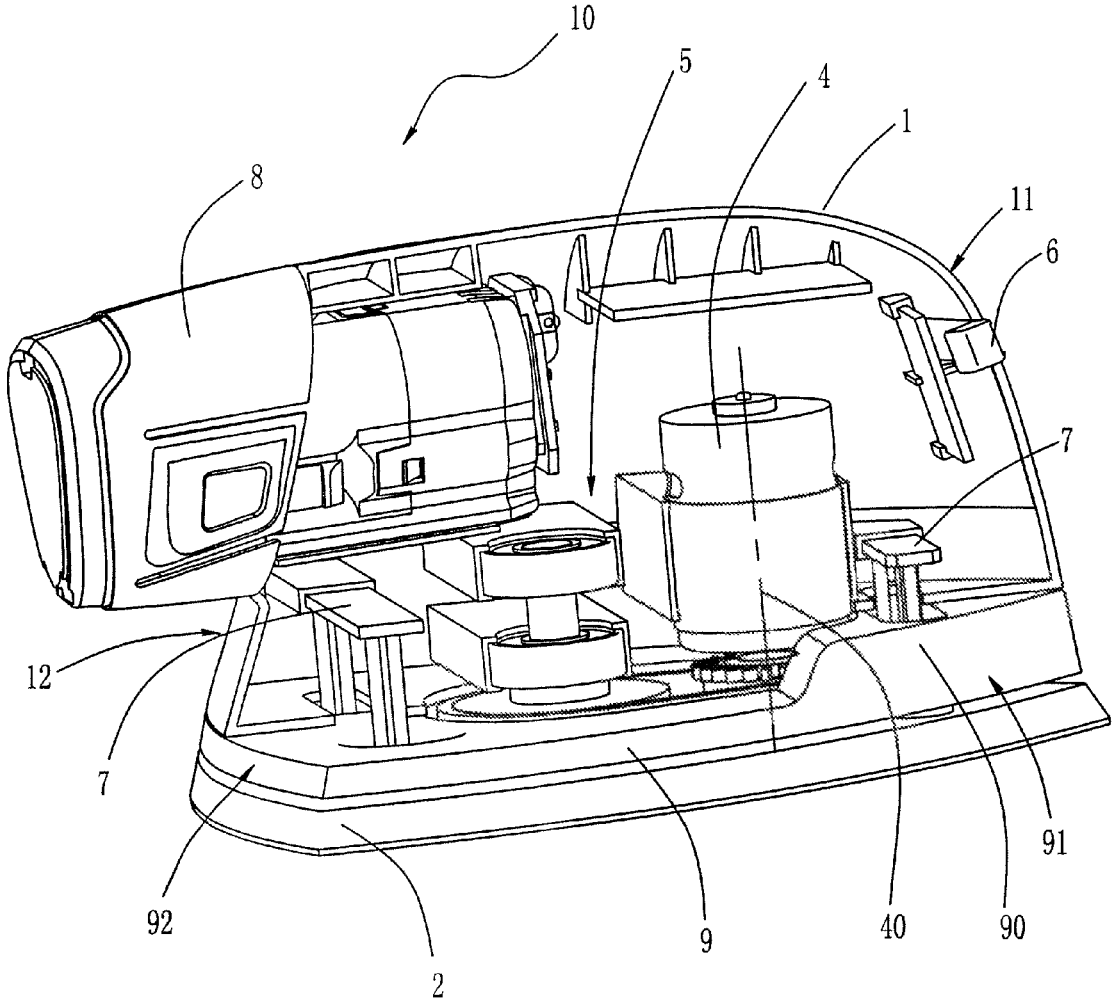
FIG. 2 is a perspective view of the inner structure of the sander.

With reference to FIG. 1, a sander 10 comprises a housing 1 and a sanding plate 2 mounted below the housing 1. The housing 1 has a front part 11 and a rear part 12. The housing 1 is composed of two half shells. A gripping part 3 is formed on the top of the housing 1. With reference to FIG. 2, a half shell is removed; and the inner structure of the sander 10 is shown. A motor 4 is mounted within the housing 1 and is connected to a transmission 5. The sanding plate 2 is mounted to an output end of the transmission 5. Accordingly, movement of the motor 4 is transferred to the sanding plate 2 through the transmission 5. A switch 6 for controlling the motor 4 is mounted on the front of the housing 1 of the sander 10. A pair of supporting members 7 are disposed within the housing 1. One end of each supporting member 7 is mounted on the inner surface of the housing 1 and the other end is connected to the sanding plate 2 to support the sanding plate 2 and reduce vibration. Any suitable transmission known in the prior art may be used in the present invention, such as a gear transmission or a belt transmission.

Figure 3:
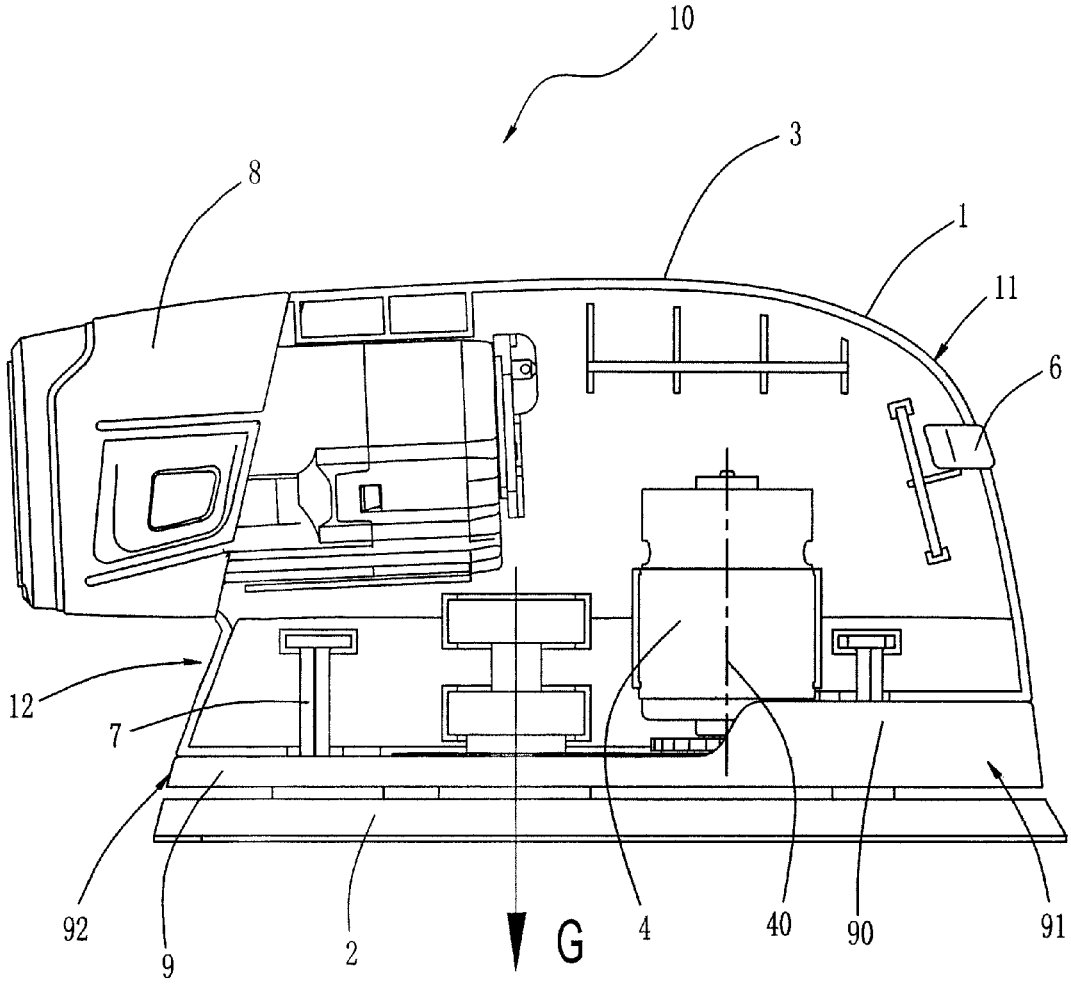
FIG. 3 is a front view of the inner structure of the sander in FIG. 2.

A battery pack 8 for supplying power to the motor 4 is mounted at the rear end of The sander 10 and on one side of a motor axis 40 facing the rear part 12 of the housing 1. Preferably, the motor axis 40 is perpendicular to the sanding plate 2. To reduce the size of the sander 10 and to make the structure compact, the motor 4 with its motor axis 40 is arranged in the front part 11 of the housing 1. Preferably, the motor axis 40 is located at a distance between ¼ and ⅖ of the total longitudinal length of the sander 10. The transmission 5 is generally disposed between the motor 4 and the battery pack 8. In the prior art, due to the weight of the battery pack 8, the center of gravity of the sander 10 is towards the rear. To solve the balance problem of the prior art, the sander 10 in the present invention includes a balancer 9 which is connected between the housing 1 and the sanding plate 2, and is fixed to one of the housing 1 and the sanding plate 2. The balancer 9 is a frame made of steel or an alloy material. The balancer 9 has a front part 91 and a rear part 92. The balancer 9 includes a balance element 90. The balance element 90 protrudes from the front part 91 of the balancer 9 and is on the side of the motor axis 40 facing the front part 11 of the housing 1, as shown in FIG. 3. Thus, the front part 91 of the balancer 9 is heavier than the rear part 92 of the balancer 9. The balance element 90 is balanced with the battery pack 8, so that the center of gravity of the sander 10 is not moved to the rear, which effectively solves the balance problem of the prior art. Preferably, the gravity line G passes through the transmission 5 when the sander 10 is placed flatly on a work table.

In the present embodiment, the outer surfaces of the balancer 9 cleanly joins the surfaces of the sanding plate 2 and the housing 1, which makes the sander 10 appear smooth. In other embodiments, the balancer 9 may be enclosed by the housing 1 either partially or completely.

In the present embodiment, the balancer 9 is made of steel or an alloy material. Alternatively, in other embodiments, the balancer 9 may be made of two or more kinds of materials. For example, the balance element 90 may be made of metallic material, and the other part of the balancer 9 may be made of plastic. This arrangement can reduce the weight of the sander

10. Those skilled in the art may recognize that the balancer 9 may have other suitable shapes and structures.

The present invention is not restricted to the embodiments disclosed hereinabove. Accordingly, any substitutes and modifications according to the spirit of the present invention will be regarded as falling within the claims appended hereto.

What is claimed is:

1. A sander comprising:

a housing, the housing having a front and a rear part;

a motor mounted within the housing;

a transmission mounted within the housing;

a sanding plate mounted below the housing;

a battery pack mounted at the rear end of the housing; and, a balancer, having a front and a rear part, mounted on one of the housing and the sanding plate, the balancer including a balance element disposed towards the front part of the balancer, wherein the outer surfaces of the balancer smoothly join the surfaces of the housing and the sanding plate.

2. The sander of claim 1, wherein the motor has a motor axis, the battery pack being located on one side of the motor axis and the balance element being located on the other side of the motor axis from the battery pack.

3. The sander of claim 2, wherein one side of the motor axis faces the rear part of the housing and the other side of the motor axis faces the front part of the housing.

4. The sander of claim 2, wherein the motor axis is perpendicular to the sanding plate.

5. The sander of claim 2, wherein the motor axis is in the front half of housing.

6. The sander of claim 2, wherein the motor axis is located between ¼ and ⅖ of the total longitudinal length of the housing.

7. The sander of claim 2, wherein the gravity line of the sander passes through the transmission when the sander is placed flatly.

8. The sander of claim 1, wherein the balancer is a frame which is disposed between the housing and sanding plate.

9. The sander of claim 1, wherein the balance element protrudes from the front part of the balancer.

10. The sander of claim 1, wherein the front part of the balancer is heavier than the rear part of the balancer.

11. A sander comprising:

a housing, the housing having a front and a rear part;

a motor having a motor axis mounted within the housing;

a transmission mounted within the housing;

a sanding plate mounted below the housing;

a battery pack mounted at the rear end of the housing; and, a balancer, having a front and a rear part, mounted on one of the housing and the sanding plate, wherein the outer surfaces of the balancer smoothly join the surfaces of the housing and the sanding plate.

12. The sander of claim 11, wherein, the balancer includes a balance element disposed towards the front part of the balancer.

13. The sander of claim 11, wherein the motor axis is in the front half of housing.

14. The sander of claim 11, wherein the motor axis is located at a point between ¼ and ⅖ of the total distance between the front part and the rear part of the housing.

15. The sander of claim 11, wherein the gravity line of the sander passes through the transmission when the sander is placed flatly.

16. The sander of claim 11, wherein the balancer is a frame which is disposed between the housing and sanding plate.

17. The sander of claim 11, wherein the balance element protrudes from the front part of the balancer.

18. The sander of claim 11, wherein the front part of the balancer is heavier than the rear part of the balancer.

* * * * *